US005417564A

United States Patent [19]

Briggs

[11] Patent Number: 5,417,564

[45] Date of Patent: May 23, 1995

[54] METHOD AND APPARATUS FOR ALTERING THE FIRING PATTERN OF AN EXISTING FURNACE

[75] Inventor: Oliver G. Briggs, Jefferson, Mass.

[73] Assignee: Riley Stoker Corporation, Worcester, Mass.

[21] Appl. No.: 188,070

[22] Filed: Jan. 27, 1994

[51] Int. Cl.[6] ..... F23C 5/08

[52] U.S. Cl. ..... 431/179; 110/263; 110/265

[58] Field of Search ..... 431/179, 174; 110/263, 110/264, 265

[56] References Cited

U.S. PATENT DOCUMENTS

| | | | |
|---|---|---|---|
| 4,245,980 | 1/1981 | Reed et al. . | |
| 4,347,052 | 8/1982 | Reed et al. . | |
| 4,907,962 | 3/1990 | Azuhata et al. . | |
| 5,067,419 | 11/1991 | Kobayashi et al. . | |
| 5,205,226 | 4/1993 | Kitto et al. | 431/174 |
| 5,231,937 | 8/1993 | Kobayashi et al. | 110/265 |

*Primary Examiner*—Carroll B. Dority

*Attorney, Agent, or Firm*—Mason, Kolehmainen, Rathburn & Wyss

[57] ABSTRACT

A new and improved method and apparatus for altering the firing pattern of an existing furnace of the type including at least one pair of vertically spaced apart burners mounted on a wall of the furnace and supplied with secondary air from a common windbox. The method involves cutting a rectangular panel from the furnace wall around a first burner wherein the burner is located asymmetrically toward a first panel end and spaced farther away from a vertically opposite second end of the panel. The cut-out panel is then reversed in orientation from end to end so that the first burner is then spaced farther apart at a greater distance from a second burner. The panel is reinstalled in the furnace wall in reverse orientation thereby providing a greater spacing or staging distance between the first and second burners producing a reduced level of $NO_x$ when the burners are fired. The increased spacing distance between the burners, the inclusion of new interstage air ports on the panels, and the addition of new burners with unique secondary air swirl orientation results in greatly improved lower $NO_X$ levels in a retrofit of an existing furnace.

10 Claims, 3 Drawing Sheets

METHOD AND APPARATUS FOR ALTERING THE FIRING PATTERN OF AN EXISTING FURNACE

BACKGROUND OF THE INVENTION

1. Field of the Invention

The present invention relates to a new and improved method and apparatus for altering the firing pattern of an existing furnace in order to produce lower levels of $NO_X$ to meet with the standards of the Clean Air Act. More particularly, the present invention relates to the alteration of the firing pattern of a cell-fired boiler or furnace without requiring new pressure part wall sections and without requiring the installation of an overfire air system with plenums separate and apart from the existing windboxes as is often required in retrofitting of furnaces to meet the new high standards of the Clean Air Act.

2. Background of the Prior Art

U.S. Pat. No. 4,245,980 discloses a burner for reduced $NO_X$ emission and control of flame spread and length wherein a burner tube is provided upstream of a first combustion zone for supplying a less than stoichiometric amount of combustion air in a tangential swirling pattern. The burner has a second plenum in coaxial relation with the first combustion zone so that tertiary air supplied tangentially to this plenum will flow in a helical swirling motion along the outside edge of the first combustion chamber around the downstream end.

U.S. Pat. No. 4,347,052 discloses a low $NO_X$ burner for firing liquid and gaseous fuels with a first air or oxidant plenum supplying primary air plus secondary air or oxidant to the liquid and/or gas burners and with the primary and secondary air providing a less than stoichiometic flow rate to provide a reducing atmosphere and preclude the formation of $NO_X$.

U.S. Pat. No. 4,907,962 discloses a low $NO_X$ pulverized coal burner including a flow nozzle for injecting pulverized coal and primary air and a secondary air nozzle around and coaxial therewith along with a tertiary air nozzle arranged externally of the secondary air so that secondary and tertiary air swirl in a flow around the primary coal/air stream to delay mixing therewith.

U.S. Pat. No. 5,067,419 discloses a low $NO_X$ burner including a flame holding plate and an unburned gas burner provided in an exhaust gas duct to noticeably reduce the concentration of $NO_X$ discharged to the outside of the system.

OBJECTS OF THE INVENTION

It is an object of the present invention to provide a new and improved method and apparatus for altering the firing pattern of an existing furnace.

More particularly it is an object of the present invention to provide a new and improved method and apparatus for altering the firing pattern of an existing furnace in a retrofitting operation wherein new pressure parts of the furnace are not required and wherein a new overfire air system with separate plenums is not required in order to reduce the levels of $NO_X$ to an acceptable level.

Still another object of the present invention is to provide a new and improved method and apparatus for retrofitting a cell-fired boiler in a fast and cost efficient manner so that reduced $NO_X$ levels are insured.

Still another object of the present invention is to provide a new and improved method and apparatus for retrofitting a cell-fired furnace wherein vertical spacing between rows of burners is increased and wherein auxiliary interstage air ports are provided between vertically staged burners.

Yet another object of the present invention is to provide a new and improved method and apparatus for altering the firing pattern of a cell-fired furnace wherein elongated, vertically extending, rectangular-shaped panels on a furnace wall surrounding a burner are cut-out of the wall with a burner located adjacent one end of the panel and the panel is then reversed in end to end orientation and reinstalled in the furnace wall thus providing greater vertical spacing between a lower burner and the reversed burner on the panel.

Yet another object of the present invention is to provide a new and improved method and apparatus for altering the firing pattern of a cell-fired furnace of the character described in the preceding object wherein an interstage air port is provided on the panel and is located generally midway between upper and lower burners after reversal of the panel and reinstallation in the furnace wall has taken place.

Still another object of the invention is to provide a new and improved method and apparatus of the character described wherein cut-out sections of a furnace wall are reversed in orientation and rejoined to the remaining wall so that new wall sections are not required and/or the cut-out wall sections are reused and not discarded or scrapped.

BRIEF SUMMARY OF THE PRESENT INVENTION

The foregoing and other object and advantages of the present invention are accomplished in a new and improved method for altering the firing pattern of an existing cell-fired furnace of the type having at least one pair of vertically spaced first and second burners mounted on a furnace wall and supplied with secondary air from a common windbox on the wall. The new and improved method involves the steps of cutting out a generally vertically elongated, rectangular-shaped panel from the existing furnace wall around a first burner which is located asymmetrically of the panel ends and is spaced closer toward a first end of the panel and farther away from an opposite second end of the panel. The panel is then reversed end to end in orientation so that the first burner is located farther away from the second burner and then the panel is reinstalled in the furnace wall whereby a greater vertical spacing distance obtains between the first and second burners for reducing the levels of $NO_X$ by providing staged combustion. An interstage air port is provided on the panel spaced toward the second to provide an injection of secondary air into the furnace at a level between the first and second burners which are positioned at greater spacing apart from one another after the panel is reversed in orientation and reinstalled in place on the furnace wall.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 1:
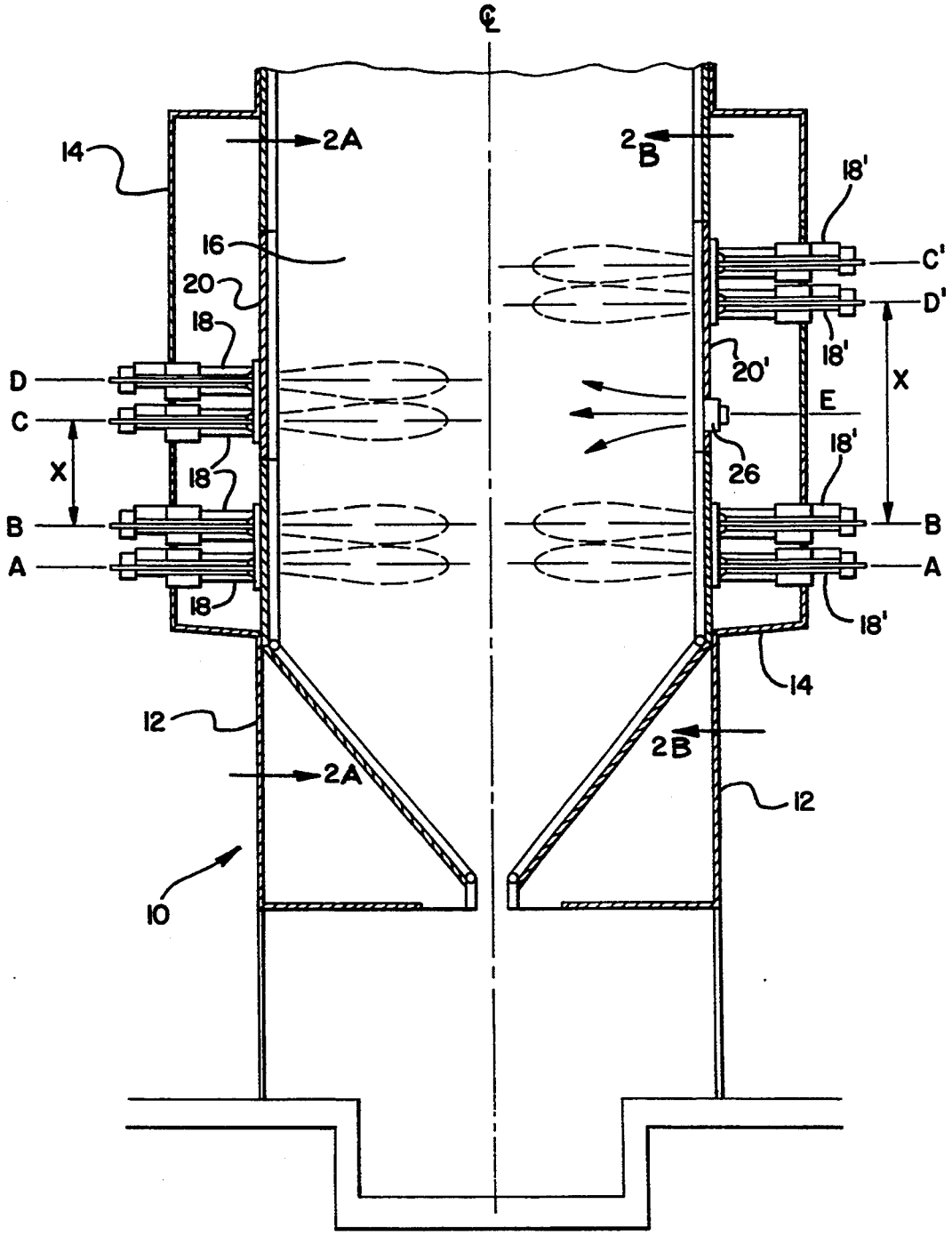
FIG. 1 is a vertical cross-sectional view illustrating to the left of a centerline therein a cell-fired furnace having several closely spaced apart horizontal rows of burners and on the right hand side of the furnace centerline is illustrated a retrofitted furnace in accordance with the present invention wherein upper rows of burners are repositioned to provide greater spacing from the lower rows for staged combustion with a row of interstage air ports between the upper and lower rows.
Figure 2B:
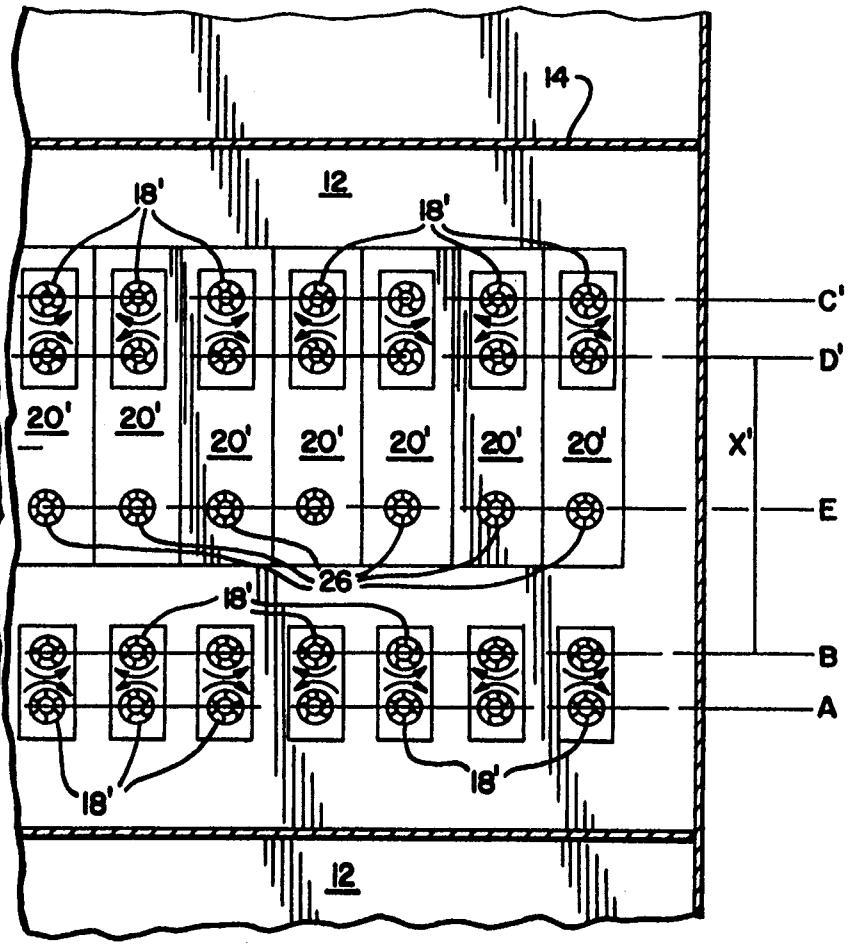
FIGS. 2A–2B comprises cross-sectional views of the furnace to the left of the centerline illustrating the cell-fired boiler before retrofitting and to the right of the centerline illustrating the furnace after being retrofitted in accordance with the present invention.
Figure 2A:
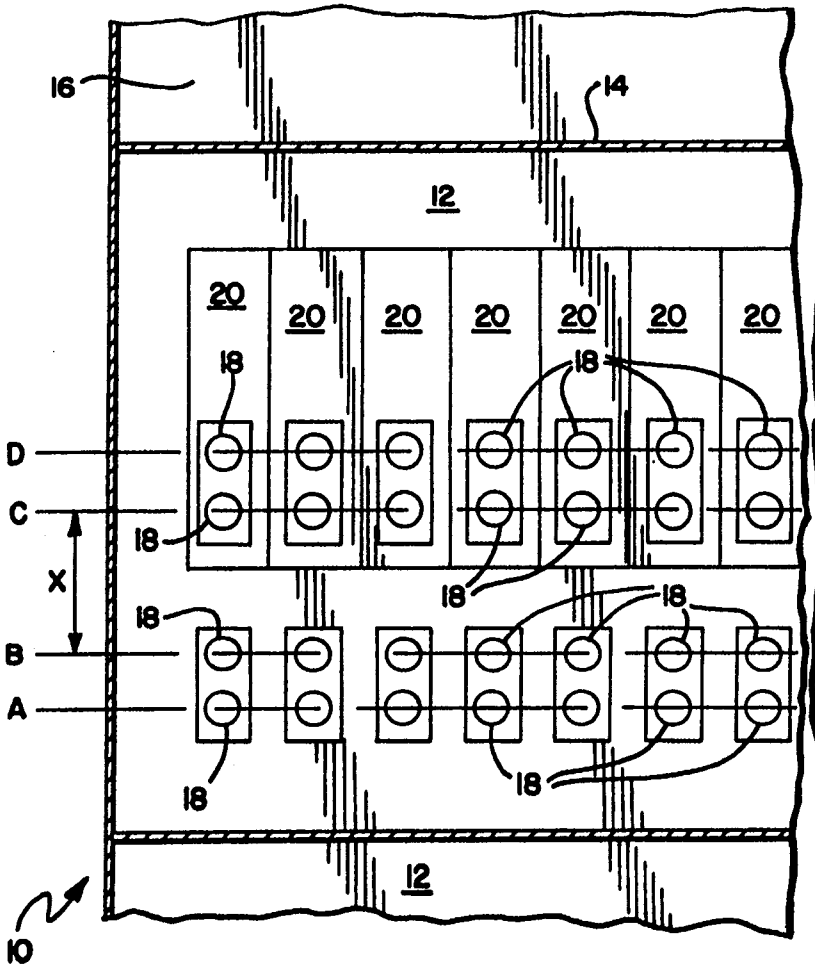
Figure 3:
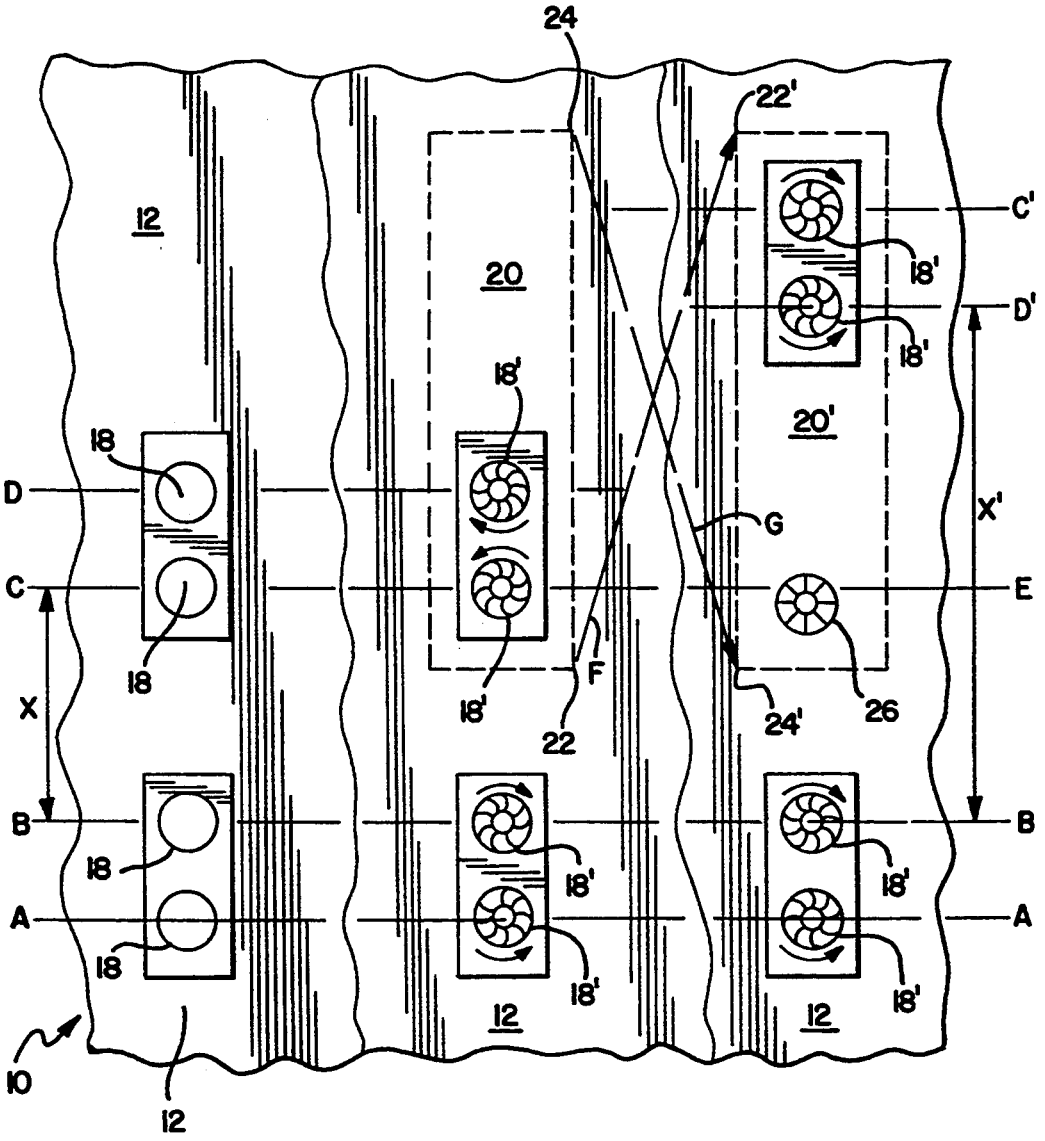
FIG. 3 illustrates in somewhat diagrammatic animated form, a method of retrofitting a cell-fired furnace in accordance with the features of the present invention.

Referring now more particularly to the drawings the left hand portions of FIGS. 1, 2 and 3 illustrate a typical cell-fired furnace 10 having vertical side walls 12 on which are mounted windboxes 14 supplied with secondary air from a blower or fan (not shown) for introduction into an interior burner chamber 16 of the furnace for oxidizing fuel such as pulverized coal. The pulverized coal is carried in a primary air stream and is introduced into the furnace 10 through a plurality of pulverized coal burners 18 arranged in horizontal rows at increasing heights indicated by the vertically spaced lines A, B, C and D. In typical fashion, the vertical spacing between the burners 18 in lower rows A and B and in upper rows C and D, respectively, is less than the vertical spacing between the burners in rows B and C. Also the number of burners 18 in a particular row may vary greatly depending upon the size of the furnace and the capacity thereof.

In accordance with the present invention, the cell-fired furnace is retrofitted to provide lower $NO_X$ emissions to meet the new Clean Air Act standards by a new and improved method which involves cutting out panels 20 of vertically elongated, rectangular shape from the wall 14. Each panel 20 is laid out or chosen so that burners 18 at levels C and D are asymmetrical with respect to a mid level centerline of the panel and are thus spaced relatively close to a lower end of the panel and relatively far from the upper end of the panel.

Referring momentarily to FIG. 3, the panel 20 is therein shown and the dotted outline represents the line of cutting on the furnace wall 12. After a panel 20 is cut-out of the furnace wall 12, the panel is reoriented or reversed end to end in a vertical sense so that a lower right hand corner 22 of the panel becomes an upper left hand corner 22' and an upper right hand corner 24 becomes a lower left hand corner 24', as indicated by the crossing arrows F and G. Thus, the cut-out panel 20 is reused in a reversed end to end orientation and no new wall sections are required. Moreover, no new panels 20 are required and the ones cut-out are reused so that the cut-out panels do not need to be thrown away or discarded. This factor alone greatly reduces the cost of retrofitting a cellular fired furnace so as to comply with the new clean air act in that no serviceable wall sections are discarded or thrown away and no new replacement sections are required.

The reversed end to end panel 20 is then reinstalled in the furnace wall 12 as illustrated in the right hand portion of FIG. 3, so that the burners are located adjacent the upper end of the reoriented panel and are spaced apart a greater distance from the burners in rows A and B. A greater vertical spacing distance X' is thus established between the burners in row B and row D' than previously existed between the burners in rows B and C before the panel 20 was cut-out, the end to end reversal was accomplished and the reinstallation of the panel 20 in the furnace wall 12 as described was completed. The greater vertical spacing distance X' between the burners in the lower pair of rows A and B and the burners in the upper pair of rows C' and D' provides internal staged combustion resulting in a reduction of $NO_X$ formation substantially below the previous levels when a smaller spacing distance X was provided.

The reduction of $NO_X$ formation is further reduced by the addition of secondary air from the windboxes 14 injected through interstage air ports 26 mounted of the panels 20 at an end portion opposite to the burners at an intermediate level E approximately midway between the burner levels B and D'. This secondary air injection isolates the burning processes of the upper burner pairs in rows C' and D' from the lower burner pairs in rows A and B, so that sub-stoichiometric firing can be established at lower burner levels, thus reducing the formation of $NO_X$ because of lower initial combustion temperatures and thereafter complete combustion of the fuel can be achieved at the upper levels C' and D' after the volatiles have been driven off initially.

In accordance with the present invention, a retrofitting operation includes replacement of the original or existing burners 18 in an existing furnace 10, with new and improved low $NO_X$ burners 18' of the type shown and described in U.S. Pat. Nos. 4,479,442 and 4,457,241, which patents are incorporated herein by reference. As more fully described in the aforementioned patents, the low $NO_X$ burners provide swirling streams of secondary and tertiary air around the primary coal/air stream thus providing staged combustion at the burner exit resulting in the reduction of $NO_X$ formation.

In accordance with the present invention and as best shown in FIGS. 2' and 3, the low $NO_X$ burners 18' provide swirling secondary and tertiary air streams that swirl in both a clockwise and a counterclockwise direction and the burners are installed so that a burner in row B will provide a swirling direction opposite to a burner in row A directly below. Similarly, a burner 18' in row C' will provide a swirl direction opposite to that of a burner 18' directly therebelow in row D'. Moreover, the direction of swirl of a burner 18' in row D' will be opposite to the direction of swirl in a burner 18' in row B directly below.

Moreover, the burners 18' in each of the rows A, B, C' and D' are arranged to provide swirling action in a direction opposite to that of a next adjacent burner in the same row. The described arrangement of swirl direction of the burners 18' in each row and column provides an extremely efficient firing system that produces very low levels of $NO_X$ and yet is highly efficient in obtaining complete combustion of the fuel.

The retrofitting of an existing furnace 10 in the manner described herein can be accomplished on a very economical basis in comparison to systems which require one or more separate overfire air plenums and/or overfire air ports. Moreover, the cutting of rectangular panels 20, reorientation and reinstallation thereof can be accomplished in a fast and efficient manner thus minimizing furnace downtime for retrofitting. The cut-out panels 20 are reused and not thrown away or scrapped, and the purchase of new or substitute panels or replacement wall sections is not required thus greatly reducing the cost of retrofitting an existing furnace installation.

The increased space or volume in the furnace chamber 16, between the burners 18' in rows B and D' provides a greater volume or space for heat release resulting in lower initial firing temperatures and a reduction of slag accumulation on the furnace walls. Moreover, in addition to pulverized coal, firing with fuels such as natural gas and oil can be utilized and the same method and apparatus as described herein for pulverized coal provides excellent low $NO_X$ levels.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A process for altering the firing pattern of an existing furnace having at least one pair of vertically spaced apart first and second burner means mounted on a wall of said furnace and supplied with secondary air from a common windbox adjacent said wall; comprising the steps of:

cutting out a panel from said furnace wall around a first burner means, said panel having a vertically elongated generally rectangular shape with said first burner means located asymmetrically toward a first end of said panel and spaced farther away from a vertically opposite second end of said panel;

reversing the orientation of said cut-out panel end to end so that said first burner means is positioned farther away at a greater spaced apart vertical distance from said second burner means; and reinstalling said panel while in said reversed orientation in said furnace wall whereby said greater vertical spacing distance between said first and second burner means produces reduced levels of $NO_X$ when said burner means are fired in said furnace.

2. The process of claim 1, including:

a plurality of said pairs of said burner means mounted on said wall, each one of a pair of said burner means having a first burner means aligned in a common first row with other first burner means and a second burner means aligned in a common second row with other second burner means;

cutting out a plurality of said panels from one of said rows;

reversing the vertical end to end orientation of said cut-out panels; and reinstalling said cut-out panels in said wall in said reversed orientation to increase the vertical spacing distance between first and second burner means in each of said pairs of burner means.

3. The process of claim 1, wherein:

at least one of said first and second burner means includes a plurality of vertically spaced apart burners.

4. The process of claim 3, wherein:

said plurality of vertically spaced apart burners comprise burners having swirl vane means for swirling an input flow of fluid into said furnace with opposite directions of swirl.

5. The process of claim 4, wherein:

said swirl vane means are positioned to impart swirling action to an input flow of secondary air into said furnace.

6. The process of claim 1, including the step of:

providing at least one interstage air port on said furnace wall for introducing air into said furnace at a level spaced between said first and second burner means when located in said reversed orientation with said greater vertical spacing distance therebetween.

7. The process of claim 6, wherein:

said interstage air port is positioned on said panel adjacent an end portion opposite said first burner means thereon.

8. The process of claim 6, wherein:

said interstage air port is positioned approximately midway between said first and second burner means.

9. The process of claim 2, including the step of:

providing at least one interstage air port on a panel adjacent an end portion thereof opposite said first burner means thereon whereby said air port is spaced between said first and second rows when said panel is in said reversed orientation.

10. The process of claim 9, wherein:

said interstage air port is positioned approximately midway between said first and second rows.

* * * * *